US012520940B2

(12) United States Patent
Li et al.

(10) Patent No.: US 12,520,940 B2
(45) Date of Patent: Jan. 13, 2026

(54) SEAT BRACKET AND SEAT

(71) Applicant: DEWERTOKIN TECHNOLOGY GROUP CO., LTD., Zhejiang (CN)

(72) Inventors: Long Li, Zhejiang (CN); Qiqi Ye, Zhejiang (CN); Liming Yang, Zhejiang (CN); Weiyao Zhou, Zhejiang (CN); Bin Shen, Zhejiang (CN); Kangming Tao, Zhejiang (CN); Guowei Wang, Zhejiang (CN)

(73) Assignee: DEWERTOKIN TECHNOLOGY GROUP CO., LTD., Jiaxing (CN)

( * ) Notice: Subject to any disclaimer, the term of this patent is extended or adjusted under 35 U.S.C. 154(b) by 262 days.

(21) Appl. No.: 18/548,742

(22) PCT Filed: Feb. 28, 2022

(86) PCT No.: PCT/CN2022/078154
§ 371 (c)(1),
(2) Date: Sep. 1, 2023

(87) PCT Pub. No.: WO2022/183997
PCT Pub. Date: Sep. 9, 2022

(65) Prior Publication Data

US 2024/0148145 A1 May 9, 2024

(30) Foreign Application Priority Data

Mar. 2, 2021 (CN) ..... 202120450536.9

(51) Int. Cl.
*A47C 1/034* (2006.01)
*A47C 1/032* (2006.01)

(52) U.S. Cl.
CPC ..... *A47C 1/0345* (2013.01); *A47C 1/03211* (2013.01)

(58) Field of Classification Search
CPC .. A47C 1/03211; A47C 1/0345; A47C 1/0355
See application file for complete search history.

(56) References Cited

U.S. PATENT DOCUMENTS

| | | | | |
|---|---|---|---|---|
| 9,433,295 | B2 * | 9/2016 | Crum | A47C 7/5068 |
| 10,420,422 | B2 * | 9/2019 | Lawson | A47C 1/0355 |
| 11,197,549 | B1 * | 12/2021 | LaPointe | A47C 1/0345 |

FOREIGN PATENT DOCUMENTS

| | | |
|---|---|---|
| CN | 106820708 A | 6/2017 |
| CN | 108260984 A | 7/2018 |

(Continued)

OTHER PUBLICATIONS

International Search Report for International Application No. PCT/CN2022/078154, dated May 11, 2022, 5 pages.

*Primary Examiner* — Milton Nelson, Jr.
(74) *Attorney, Agent, or Firm* — CANTOR COLBURN LLP

(57) ABSTRACT

A seat bracket includes a base mechanism, an electric motor, a transmission mechanism, and a scissor mechanism, where the transmission mechanism includes a transmission piece, a transmission rod, and a link, the transmission piece and the transmission rod are rotatably connected through the link, the transmission piece is rotatably connected to the scissor mechanism, the transmission rod is rotatably connected to the base mechanism, the electric motor is disposed in the base mechanism, an output end of the electric motor is connected to the transmission rod, and the electric motor is configured to drive the transmission rod to cause the transmission rod to drive the transmission piece and the link to rotate so that the scissor mechanism extends or retracts.

16 Claims, 3 Drawing Sheets

(56) References Cited

FOREIGN PATENT DOCUMENTS

| | | | |
|---|---|---|---|
| CN | 109008405 | A | 12/2018 |
| CN | 111990817 | A | 11/2020 |
| JP | 2011103910 | A | 6/2011 |
| WO | 2019060437 | A1 | 3/2019 |
| WO | 2020056572 | A1 | 3/2020 |

* cited by examiner

SEAT BRACKET AND SEAT

CROSS-REFERENCE TO RELATED APPLICATION(S)

This is a national stage application filed under 37 U.S.C. 371 based on International Patent Application No. PCT/CN2022/078154, filed Feb. 28, 2022, which claims priority to Chinese Patent Application No. 202120450536.9 filed with the China National Intellectual Property Administration (CNIPA) on Mar. 2, 2021, the disclosure of which is incorporated herein by reference in its entirety.

TECHNICAL FIELD

The present application relates to the field of seat manufacturing, for example, a seat bracket and a seat.

BACKGROUND

With the improvement of people's living standards, automated furniture is used more widely in different life scenarios. Sofa seats serve as the furniture commonly used in life for home leisure. Besides, automated functional sofa seats of different styles and with different structures can be used in different environments such as cinema, massage, high-speed railway, and airplane. In the related art, to rotate a backrest and a leg rest to be convenient for a human body to lie down, a sofa seat is generally provided with an electric motor, a transmission mechanism, and a scissor mechanism, so as to adjust an angle at which a backrest of a sofa is inclined and an extension length and height of a leg rest of the sofa, thereby facilitating the use of the sofa seat by a user and improving the comfort of the sofa seat during use. However, the transmission mechanism and the scissor mechanism of a bracket of the sofa seat in the related art are relatively complex in structure and occupy a relatively large space.

SUMMARY

The present application provides a seat bracket and a seat, which are simple in structure and good in stability.

In a first aspect, the present application provides a seat bracket.

The seat bracket includes a base mechanism, an electric motor, a transmission mechanism, and a scissor mechanism, where the transmission mechanism includes a transmission piece, a transmission rod, and a link, the transmission piece and the transmission rod are rotatably connected through the link, the transmission piece is rotatably connected to the scissor mechanism, the transmission rod is rotatably connected to the base mechanism, the electric motor is disposed in the base mechanism, an output end of the electric motor is connected to the transmission rod, and the electric motor is configured to drive the transmission rod to cause the transmission rod to drive the transmission piece and the link to rotate so that the scissor mechanism extends or retracts.

In a second aspect, the present application further provides a seat including a support base and the preceding seat bracket, where the support base abuts against the outside of the base mechanism.

REFERENCE LIST

Figure 1:
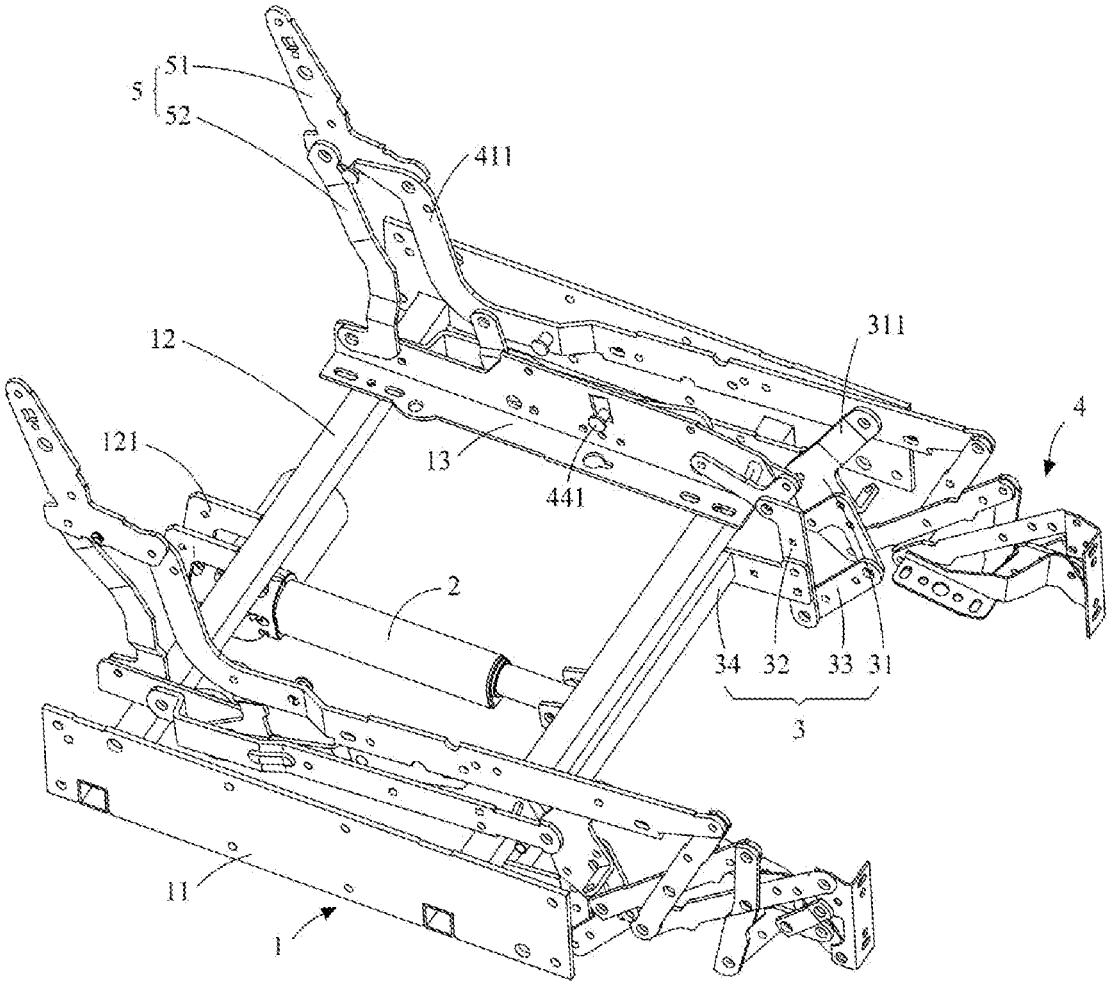
FIG. 1 is a schematic view of the overall structure of a seat bracket according to an embodiment of the present application.

1 base mechanism
11 side plate
12 support
121 fixing frame
13 mounting plate
2 electric motor
3 transmission mechanism
31 transmission piece
311 connecting strut
32 transmission rod
33 link
34 drive tube
4 scissor mechanism
41 connecting assembly
411 first connecting rod
412 second connecting rod
42 linkage assembly
421 first link
422 second link
423 third link
424 fourth link
43 leg rest assembly
431 first leg rest link
432 second leg rest link
433 primary leg rest
434 secondary leg rest
44 first connector
441 limiting protrusion
5 backrest mechanism
51 backrest main rod
52 backrest rotating rod

DETAILED DESCRIPTION

The present application is described in detail below in conjunction with the drawings and embodiments.

In the description of the embodiments, terms "joined", "connected", and "fixed" are to be understood in a broad sense unless otherwise expressly specified and limited. For example, the term "connected" may refer to "fixedly connected", "detachably connected", or "integrated", may refer to "mechanically connected" or "electrically connected", or may refer to "connected directly", "connected indirectly through an intermediary", or "connected inside two elements" or an interaction relation between two elements. For those of ordinary skill in the art, specific meanings of the preceding terms in the present application may be understood based on specific situations.

In the embodiments, unless otherwise expressly specified and limited, when a first feature is described as "on" or "under" a second feature, the first feature and the second feature may be in direct contact or may be in contact via another feature between the two features instead of being in direct contact. Moreover, when the first feature is described as "on", "above", or "over" the second feature, the first feature is right on, above, or over the second feature, the first feature is obliquely on, above, or over the second feature, or the first feature is simply at a higher level than the second feature. When the first feature is described as "under", "below", or "underneath" the second feature, the first feature is right under, below; or underneath the second feature, the first feature is obliquely under, below; or underneath the second feature, or the first feature is simply at a lower level than the second feature.

In the description of the embodiments, orientations or position relations indicated by terms such as "upper", "lower", and "right" are based on the drawings. These orientations or position relations are intended only to facilitate description and simplify operation and not to indicate or imply that a device or element referred to must have such particular orientations or must be configured or operated in such particular orientations. Thus, these orientations or position relations are not to be construed as limiting the present application. Moreover, terms such as "first" and "second" are used only for distinguishing description and have no special meanings.

This embodiment provides a seat bracket, which relates to the field of seat manufacturing. As shown in FIGS. 1 to 4, the seat bracket includes a base mechanism 1, an electric motor 2, a transmission mechanism 3, and a scissor mechanism 4, where the transmission mechanism 3 includes a transmission piece 31, a transmission rod 32, and a link 33, the transmission piece 31 and the transmission rod 32 are rotatably connected through the link 33, the transmission piece 31 is rotatably connected to the scissor mechanism 4, the transmission rod 32 is rotatably connected to the base mechanism 1, the electric motor 2 is disposed in the base mechanism 1, an output end of the electric motor 2 is connected to the transmission rod 32, and the electric motor 2 is configured to drive the transmission rod 32 to cause the transmission rod 32 to drive the transmission piece 31 and the link 33 to rotate so that the scissor mechanism 4 extends or retracts.

The transmission rod 32 and the transmission piece 31 are rotatably connected through the link 33, the transmission piece 31 is connected to the scissor mechanism 4 and an end of the link 33 separately, the transmission rod 32 is connected to the base mechanism 1 and the other end of the link 33 separately, the output end of the electric motor 2 is connected to the transmission rod 32, and the electric motor 2 pushes the transmission rod 32 to move so that the transmission piece 31 and the link 33 rotate to drive the scissor mechanism 4 to extend or retract. The seat bracket provided in this embodiment uses the transmission mechanism 3 for driving the scissor mechanism 4 to move, is simple in structure and convenient to install, and achieves stable transmission.

Figure 2:
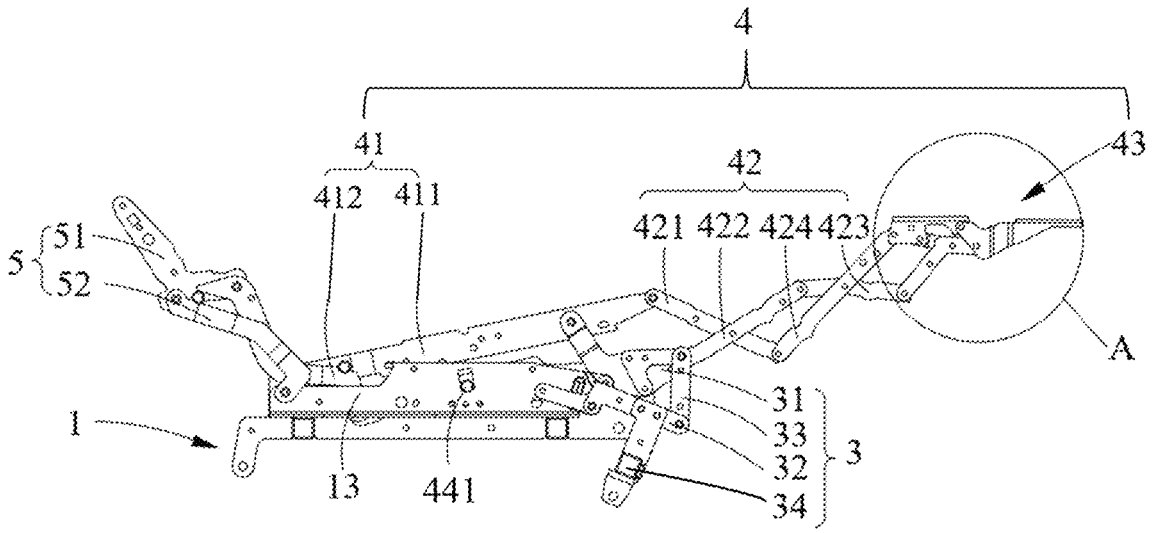
FIG. 2 is a structural view of a TV posture of a seat bracket according to an embodiment of the present application.

Optionally, as shown in FIGS. 1 to 4, the scissor mechanism 4 includes a connecting assembly 41, a linkage assembly 42, and a leg rest assembly 43, where the connecting assembly 41 includes a first connecting rod 411 and a second connecting rod 412 connected to the first connecting rod 411, the linkage assembly 42 is a cross-connected four-bar linkage structure, and a first link 421 is connected to the first connecting rod 411. The transmission piece 31 is provided with a connecting strut 311, the connecting strut 311 is connected to the first connecting rod 411, and a third link 423 and a fourth link 424 are connected to the leg rest assembly 43 separately: A second link 422 is connected to the second connecting rod 412 through the transmission piece 31. For example, the transmission piece 31 is connected to the first connecting rod 411 through the connecting strut 311, and the first connecting rod 411 is connected to the second connecting rod 412. When the electric motor 2 drives the transmission mechanism 3 to rotate, the transmission piece 31 drives the first connecting rod 411 and the second connecting rod 412 to rotate so that the linkage assembly 42 lengthens or shortens. The electric motor 2 drives the transmission mechanism 3 so that the transmission piece 31 rotates counterclockwise (to the right as shown in FIG. 2), the transmission piece 31 drives the first connecting rod 411 and the second connecting rod 412 to rotate, and thus the linkage assembly 42 lengthens to the right (the right as shown in FIG. 2), so as to adjust the seat bracket to a TV posture or a reclining posture. The electric motor 2 drives the transmission mechanism 3 so that the transmission piece 31 rotates clockwise, and thus the linkage assembly 42 and the leg rest assembly 43 retract, so as to adjust the seat bracket to a sitting posture.

Figure 3:
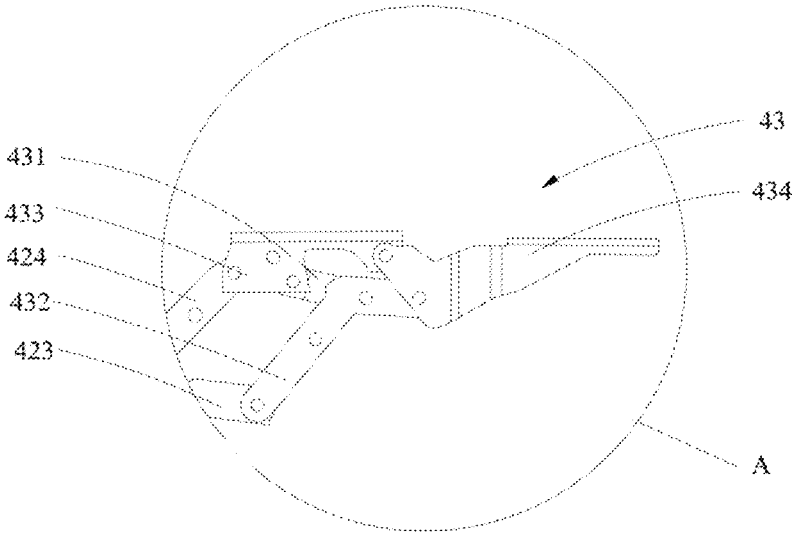
FIG. 3 is a partial enlarged view of position A of FIG. 2.
Figure 4:
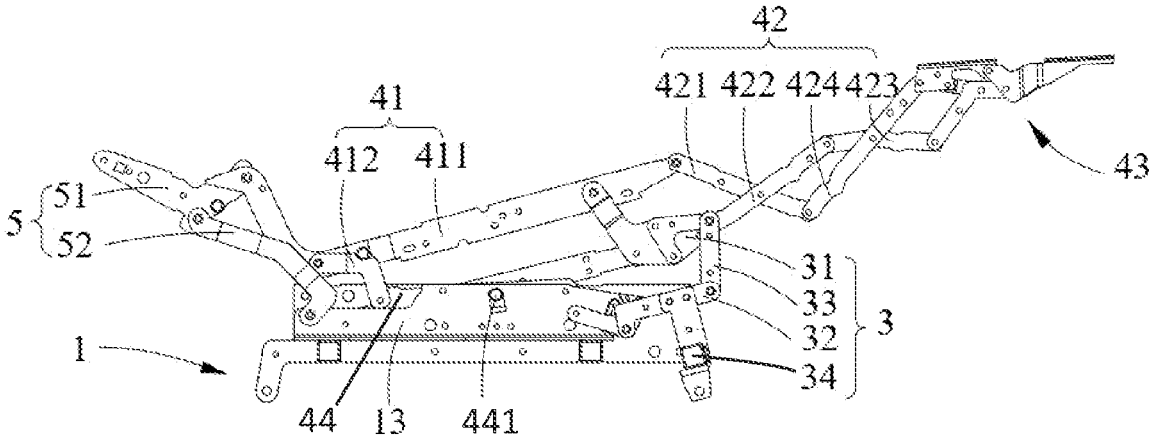
FIG. 4 is a structural view of a reclining posture of a seat bracket according to an embodiment of the present application.

Optionally, as shown in FIGS. 3 and 4, the leg rest assembly 43 includes a first leg rest link 431, a second leg rest link 432, a primary leg rest 433, and a secondary leg rest 434, where the second leg rest link 432 is connected to the first leg rest link 431, the primary leg rest 433 is connected to the fourth link 424 and the first leg rest link 431 separately, the secondary leg rest 434 is connected to the primary leg rest 433 and the second leg rest link 432 separately, and the second leg rest link 432 is connected to the third link 423. After the linkage assembly 42 lengthens, the primary leg rest 433 and the secondary leg rest 434 extend by use of the first leg rest link 431 and the second leg rest link 432.

Particularly, as shown in FIG. 4, the seat bracket further includes a backrest mechanism 5, where the backrest mechanism 5 includes a backrest main rod 51 and a backrest rotating rod 52 connected to the backrest main rod 51, the backrest main rod 51 is connected to the first connecting rod 411, and the backrest rotating rod 52 is connected to the base mechanism 1. The backrest main rod 51 is connected to the first connecting rod 411, and the backrest rotating rod 52 is connected to the base mechanism I so that when the transmission piece 31 drives the first connecting rod 411 to rotate, the backrest main rod 51 and the backrest rotating rod 52 rotate correspondingly, thereby improving the comfort of the seat bracket during use.

Particularly, as shown in FIGS. 1 and 4, the base mechanism 1 includes two side plates 11 symmetrically arranged, a support 12 connected to the two side plates 11, and a mounting plate 13 disposed on the support 12 (as shown in FIG. 1), where the transmission rod 32 and the backrest rotating rod 52 are connected to the mounting plate 13. The mounting plate 13 is disposed on the support 12, and the transmission rod 32 and the backrest rotating rod 52 are connected to the mounting plate 13, which facilitates a simple structure and convenience of installation and does not increase a space occupied by the base mechanism 1.

Particularly, as shown in FIG. 4, the second connecting rod 412 is connected to an end of a first connector 44, the other end of the first connector 44 is connected to the mounting plate 13, the first connector 44 is provided with a limiting protrusion 441, the mounting plate 13 is provided with a corresponding limiting slot, and the limiting protrusion 441 is engaged in the limiting slot. When the seat mechanism is adjusted to the reclining posture, the limiting protrusion 441 moves upward along the limiting slot. When the seat mechanism is adjusted from the reclining posture to the sitting posture, the limiting protrusion 441 moves downward along the limiting slot. This embodiment provides two postures besides the sitting posture. In a first posture (TV posture), the backrest mechanism 5 and the scissor mechanism 4 both lengthen and do not extend completely, facilitating the viewing of a television by a user, where the limiting protrusion 441 is engaged with a lower surface of the limiting slot (as shown in FIG. 2). In a second posture (reclining posture), the backrest mechanism 5 and the scissor mechanism 4 extend completely (as shown in FIG. 4), where the limiting protrusion 441 moves upward and abuts against an upper surface of the limiting slot, thereby improving the comfort of the user.

Particularly, as shown in FIG. 4, the transmission rod 32 is an L-shaped structure, an end of the transmission rod 32 is connected to the mounting plate 13, the other end of the transmission rod 32 is connected to the link 33, and the middle of the transmission rod 32 is connected to the output end of the electric motor 2. The transmission rod 32 is configured to be the L-shaped structure, thereby increasing the structural strength of the transmission rod 32 and enhancing transmission stability. An end of the transmission rod 32 is connected to the mounting plate 13, and the other end of the transmission rod 32 is connected to the link 33 to be connected to the transmission piece 31, facilitating transmission. The middle of the transmission rod 32 is connected to the output end of the electric motor 2 so that the electric motor 2 can drive the transmission rod 32 to rotate.

Particularly, the transmission mechanism 3 further includes a drive tube 34, the output end of the electric motor 2 is connected to the drive tube 34, and an end of the drive tube 34 is connected to the transmission rod 32 (as shown in FIG. 1). A single electric motor 2 is used for driving, the drive tube 34 is disposed so that the electric motor 2 is disposed on the lower side of the base mechanism 1, and the output end of the electric motor 2 is connected to the drive tube 34 and the drive tube 34 is connected to the transmission rod 32, thereby achieving transmission.

Particularly, a fixing frame 121 is provided on the support 12, and the electric motor 2 is fixed on the fixing frame 121. The fixing frame 121 is disposed on the support 12 so that the electric motor 2 is fixed at a lower end of the support 12 (as shown in FIG. 1), thereby saving a space occupied by the electric motor 2 and achieving a simple structure, practicability, and convenience.

This embodiment further provides a working process of the seat bracket.

The electric motor 2 drives the drive tube 34 to cause the drive tube 34 to drive the transmission mechanism 3 to rotate, the transmission piece 31 rotates counterclockwise and drives the connecting assembly 41 to rotate (as shown in FIG. 2) so that the linkage assembly 42 lengthens, the leg rest assembly 43 is connected to the linkage assembly 42 so that the primary leg rest 433 and the secondary leg rest 434 rotate counterclockwise to increase a leg rest area, and the backrest mechanism 5 rotates with the first connecting rod 411 so that the seat bracket changes from the sitting posture to the TV posture and then to the reclining posture. The process of the transmission piece 31 rotating clockwise to cause the linkage assembly 42 and the leg rest assembly 43 to retract is similar to the extension of the seat bracket, and the details are not described in detail here.

This embodiment further provides a seat including a support base and the preceding seat bracket, where the support base abuts against the outside of a base mechanism of the seat bracket, thereby facilitating the installation of the seat.

What is claimed is:

1. A seat bracket, comprising:

a base mechanism, an electric motor, a transmission mechanism, and a scissor mechanism, wherein the transmission mechanism comprises a transmission piece, a transmission rod, and a link, the transmission piece and the transmission rod are rotatably connected through the link, the transmission piece is rotatably connected to the scissor mechanism, the transmission rod is rotatably connected to the base mechanism, the electric motor is disposed in the base mechanism, an output end of the electric motor is connected to the transmission rod, and the electric motor is configured to drive the transmission rod to cause the transmission rod to drive the transmission piece and the link to rotate so that the scissor mechanism extends or retracts, wherein the scissor mechanism comprises:

a connecting assembly comprising a first connecting rod and a second connecting rod connected to the first connecting rod; and a linkage assembly and a leg rest assembly, wherein the linkage assembly is a cross-connected four-bar linkage structure and comprises a first link, a second link, a third link, and a fourth link, the first link is connected to the first connecting rod, the second link is connected to the second connecting rod through the transmission piece, the transmission piece is provided with a connecting strut, the connecting strut is connected to the first connecting rod, and the third link and the fourth link are connected to the leg rest assembly separately; and wherein the leg rest assembly comprises a first leg rest link, a second leg rest link, a primary leg rest, and a secondary leg rest, wherein the second leg rest link is connected to the first leg rest link, the primary leg rest is connected to the fourth link and the first leg rest link separately, the secondary leg rest is connected to the primary leg rest and the second leg rest link separately, and the second leg rest link is connected to the third link.

2. The seat bracket according to claim 1, further comprising a backrest mechanism, wherein the backrest mechanism comprises a backrest main rod and a backrest rotating rod connected to the backrest main rod, the backrest main rod is connected to the first connecting rod, and the backrest rotating rod is connected to the base mechanism.

3. The seat bracket according to claim 2, wherein the base mechanism comprises two side plates symmetrically arranged, a support connected to the two side plates, and a mounting plate disposed on the support, wherein the transmission rod and the backrest rotating rod are connected to the mounting plate.

4. The seat bracket according to claim 3, wherein the transmission rod is an L-shaped structure, an end of the transmission rod is connected to the mounting plate, another end of the transmission rod is connected to the link, and a middle of the transmission rod is connected to the output end of the electric motor.

5. The seat bracket according to claim 4, wherein the transmission mechanism further comprises a drive tube, the output end of the electric motor is connected to the drive tube, and an end of the drive tube is connected to the transmission rod.

6. The seat bracket according to claim 3, wherein the second connecting rod is connected to an end of a first connector, another end of the first connector is connected to the mounting plate, the first connector is provided with a limiting protrusion, the mounting plate is provided with a limiting slot corresponding to the limiting protrusion, and the limiting protrusion is engaged in the limiting slot.

7. The seat bracket according to claim 3, wherein a fixing frame is provided on the support, wherein the fixing frame is configured to fix the electric motor.

8. A seat, comprising a support base and the seat bracket according to claim 1, wherein the support base abuts against an outside of the base mechanism.

9. The seat according to claim 8, wherein the scissor mechanism comprises:

a connecting assembly comprising a first connecting rod and a second connecting rod connected to the first connecting rod; and a linkage assembly and a leg rest assembly, wherein the linkage assembly is a cross-connected four-bar linkage structure and comprises a first link, a second link, a third link, and a fourth link, the first link is connected to the first connecting rod, the second link is connected to the second connecting rod through the transmission piece, the transmission piece is provided with a connecting strut, the connecting strut is connected to the first connecting rod, and the third link and the fourth link are connected to the leg rest assembly separately.

10. The seat according to claim 9, wherein the leg rest assembly comprises a first leg rest link, a second leg rest link, a primary leg rest, and a secondary leg rest, wherein the second leg rest link is connected to the first leg rest link, the primary leg rest is connected to the fourth link and the first leg rest link separately, the secondary leg rest is connected to the primary leg rest and the second leg rest link separately, and the second leg rest link is connected to the third link.

11. The seat according to claim 9, wherein the seat bracket further comprises a backrest mechanism, wherein the backrest mechanism comprises a backrest main rod and a backrest rotating rod connected to the backrest main rod, the backrest main rod is connected to the first connecting rod, and the backrest rotating rod is connected to the base mechanism.

12. The seat according to claim 11, wherein the base mechanism comprises two side plates symmetrically arranged, a support connected to the two side plates, and a mounting plate disposed on the support, wherein the transmission rod and the backrest rotating rod are connected to the mounting plate.

13. The seat according to claim 12, wherein the transmission rod is an L-shaped structure, an end of the transmission rod is connected to the mounting plate, another end of the transmission rod is connected to the link, and a middle of the transmission rod is connected to the output end of the electric motor.

14. The seat according to claim 13, wherein the transmission mechanism further comprises a drive tube, the output end of the electric motor is connected to the drive tube, and an end of the drive tube is connected to the transmission rod.

15. The seat according to claim 12, wherein the second connecting rod is connected to an end of a first connector, another end of the first connector is connected to the mounting plate, the first connector is provided with a limiting protrusion, the mounting plate is provided with a limiting slot corresponding to the limiting protrusion, and the limiting protrusion is engaged in the limiting slot.

16. The seat according to claim 12, wherein a fixing frame is provided on the support, wherein the fixing frame is configured to fix the electric motor.

* * * * *